US005209367A

United States Patent [19]

Van Musscher et al.

[11] Patent Number: 5,209,367

[45] Date of Patent: May 11, 1993

[54] SLEEVE FOR A CONTAINER

[76] Inventors: Ronald F. Van Musscher, 15 Disraeli Street, Mount Eden, Auckland; Barry V. James, 11 Brookview Court, Hamilton, both of New Zealand

[21] Appl. No.: 780,733

[22] Filed: Oct. 18, 1991

Related U.S. Application Data

[63] Continuation-in-part of Ser. No. 517,156, May 1, 1990, abandoned.

[30] Foreign Application Priority Data

May 3, 1989 [NZ] New Zealand ..... 228964

[51] Int. Cl.[5] ..... B65D 65/08

[52] U.S. Cl. ..... 220/401; 220/903; 220/737; 220/682

[58] Field of Search ..... 229/89; 150/901; 220/903, 739, 737, 400, 401, 682

[56] References Cited

U.S. PATENT DOCUMENTS

| | | | |
|---|---|---|---|
| 228,002 | 5/1880 | Swope | 229/89 |
| 234,582 | 11/1880 | Kacer | 229/89 |
| 248,770 | 10/1881 | Mark et al. | 229/89 |
| 2,201,779 | 5/1940 | Lathrop | 220/400 |
| 2,464,653 | 3/1949 | Phipps | 220/682 |
| 3,353,729 | 11/1967 | Hull | 220/737 |
| 3,654,049 | 4/1972 | Ausnit | 220/903 |
| 4,796,937 | 1/1989 | Andrea | 220/739 |
| 5,102,036 | 4/1992 | Orr et al. | 229/89 |

FOREIGN PATENT DOCUMENTS

| | | | |
|---|---|---|---|
| 2400 | 1/1892 | United Kingdom | 150/901 |

*Primary Examiner*—Stephen P. Garbe
*Assistant Examiner*—S. Castellano
*Attorney, Agent, or Firm*—Abelman Frayne & Schwab

[57] ABSTRACT

A sleeve for a container such as a drink can or bottle is adapted to be slipped onto the container so that it is a tight fit thereon. The sleeve insulates against heat gains or losses and provides a relatively inexpensive vehicle for advertising in the form of product or service endorsements, competition advertising and such like.

2 Claims, 6 Drawing Sheets

SLEEVE FOR A CONTAINER

This is a continuation-in-part of Ser. No. 07/517,156 filed on May 1, 1990 now abandoned.

This invention relates to sleeves for positioning over drink or other containers primarily for the purpose of insulation.

At the present time many drinks such as beers, soft drinks, fruit juices, coffee, tea and the like are sold in metal cans. The thin metal of a drink can is not a particularly good insulator and during hot days the coolness of a chilled can and drink can be quickly lost. If a cold can is held by hand there is also heat transfer from the hand to the liquid within the can. Conversely with hot drinks heat is lost and the can can not be held comfortably.

There are at present available in New Zealand and Australia a range of insulating containers or jackets for cans and bottles known as coolers. The coolers are generally open topped containers or insulating jackets and those which are available are designed for both bottles and cans. The coolers which are designed for small bottles and cans of a similar but not identical diameter, are not tight fitting and as a result insulation qualities are diminished. New Zealand registered design Nos. 17866/67/68/69 are examples of such coolers. The coolers are often sold on behalf or with the endorsement of drink manufacturers or other advertisers who are attracted to them as a form of advertising and label reinforcement. However, the cost of these articles, generally in the range five to ten dollars, restricts their scope of use as they are too expensive to be given away as part of a promotional exercise.

An object of the present invention is to provide an insulating sleeve for a drinks container which exhibits good insulation qualities and which can be produced at very low cost.

Further objects and advantages of the present invention will become apparent from the ensuing description which is given by way of example.

According to the present invention there is provided a sleeve for a container comprising a flat piece of sheet material of sufficient area to cover a substantial portion of the sides of a container such as a can or a bottle, said sheet material having a joint at its longitudinal edges which can be used to join the sleeve when it is formed into a cylinder which determines the diameter of and secures the ends of the cylinder so that it is a push fit on the container to which it is fitted.

The sleeve material can be up to 2.5 millimeters thick.

The sleeve can be produced at very low cost if the sheet material is cardboard, a suitable board being 370 micron manilla. An alternative, which makes the sleeve slightly more expensive but which may be more acceptable to catering and other service industries, would be to produce the sleeve from a plastics sheet, or a laminate of cardboard and plastics film.

Figure 1:
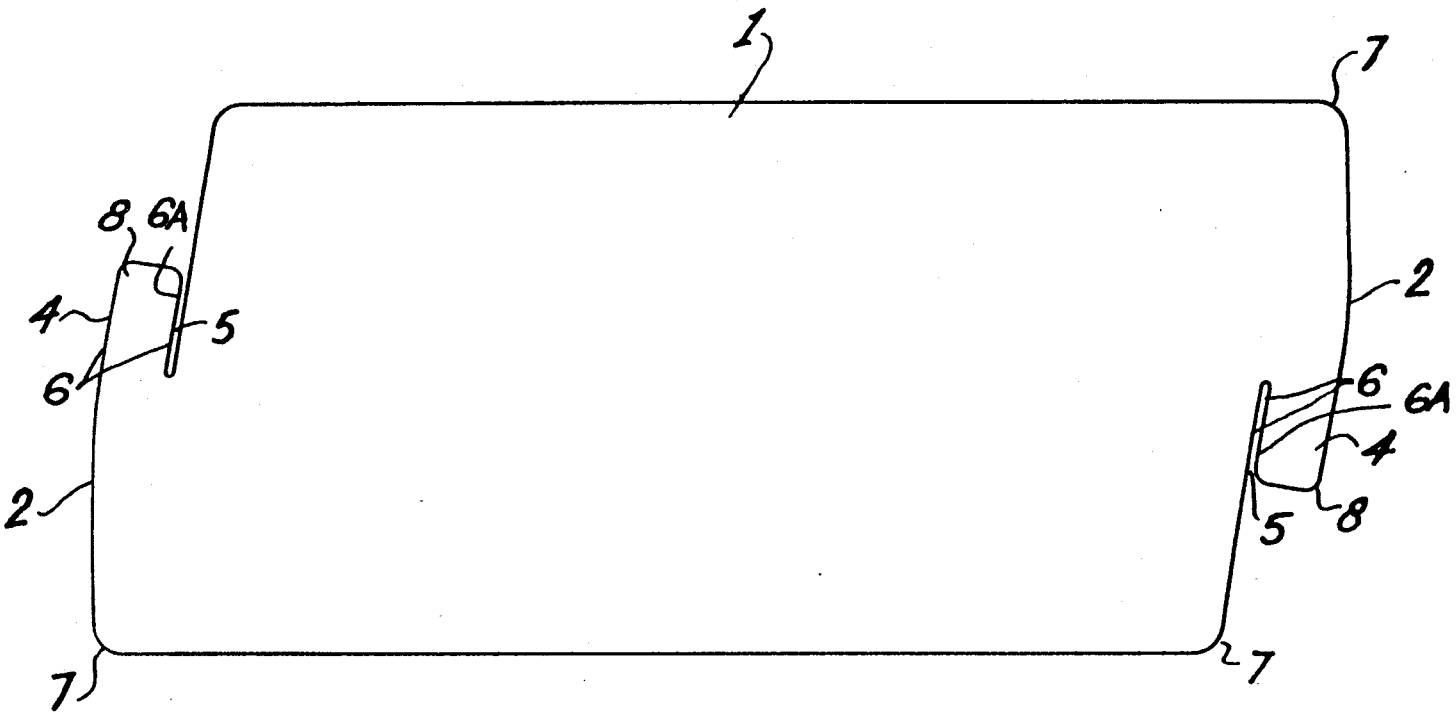
Figure 2A:
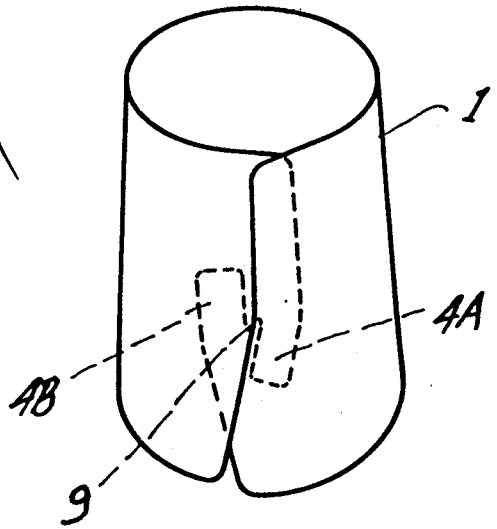
Figure 2:
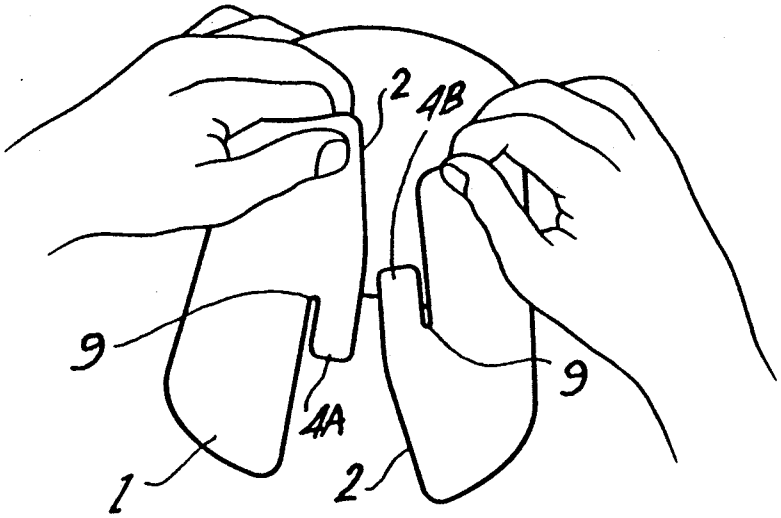
Figure 3A:
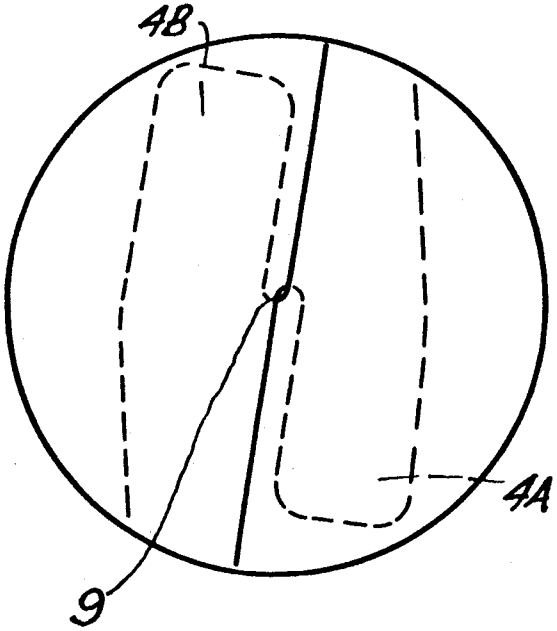
Figure 3:
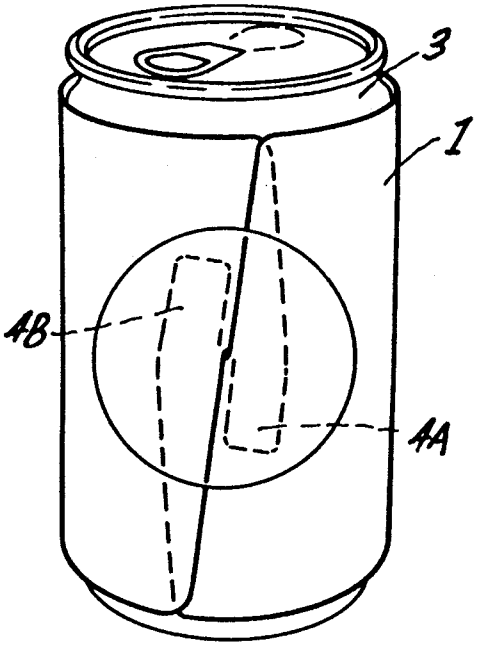
Figure 4:
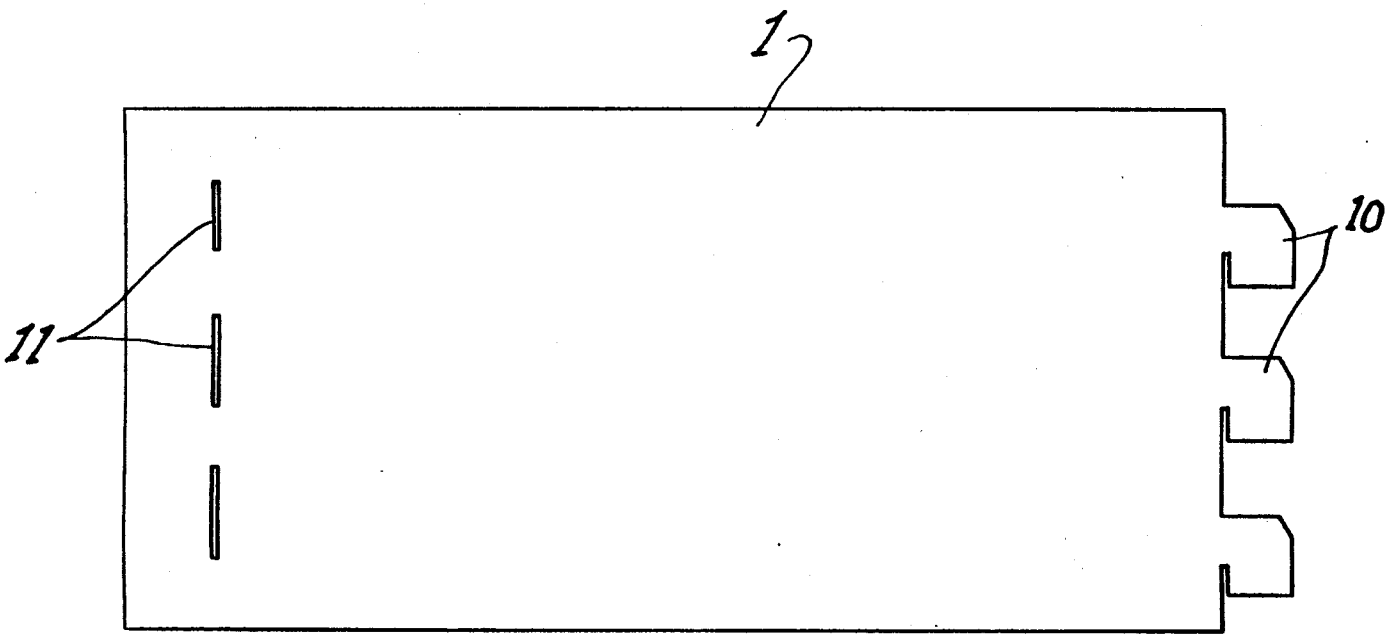
Figure 5:
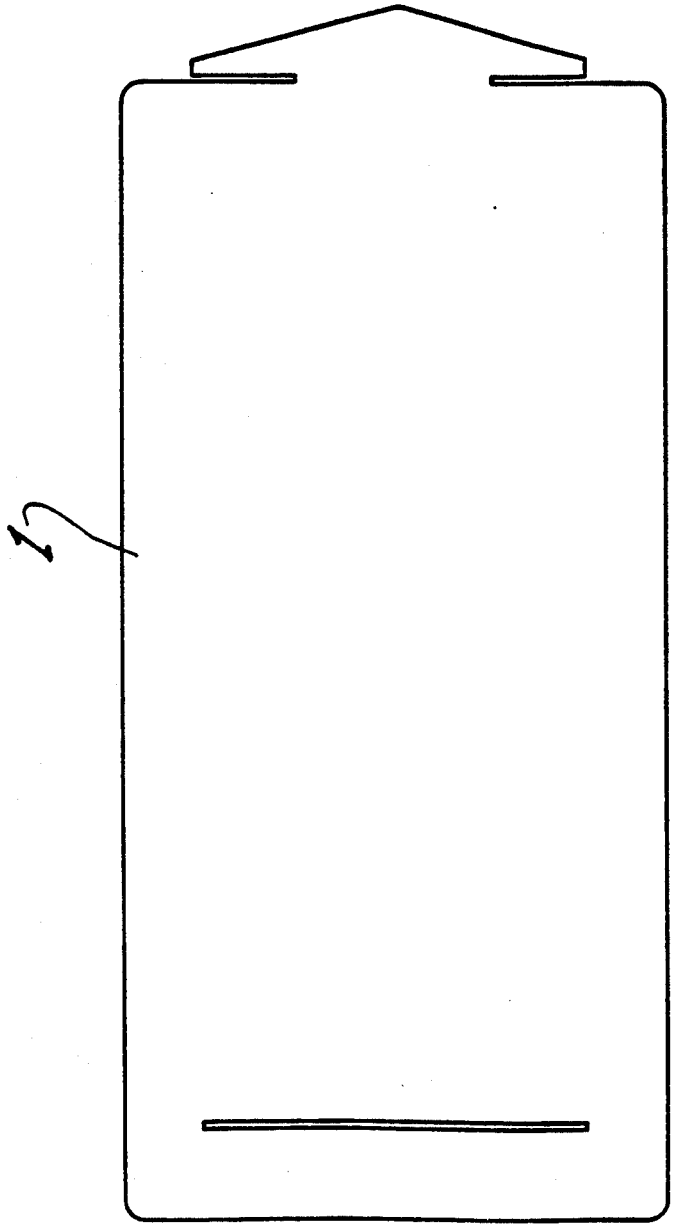
Figure 6:
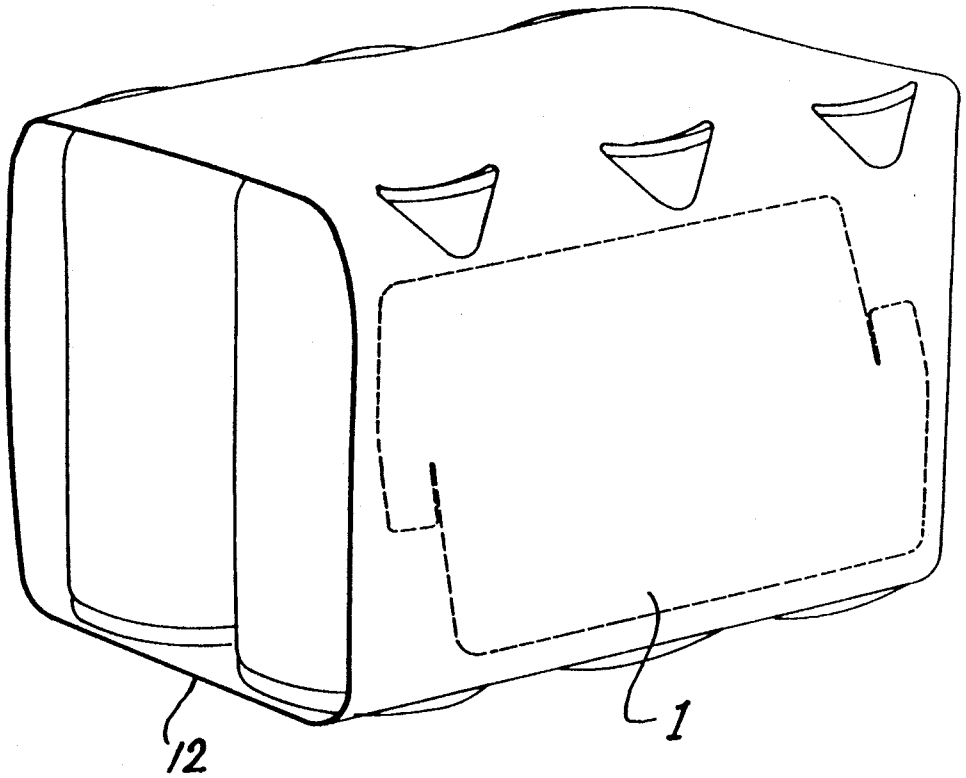

Aspects of the present invention will now be described with reference to the accompanying drawings in which:

FIG. 1 is a plan view of a sleeve in accordance with one possible embodiment of the present invention, FIGS. 2 and 2A show the sleeve of FIG. 1 in the process of being formed into a cylinder, and FIG. 3 shows the sleeve of FIG. 1 positioned on a drinks can, and FIG. 3A is an enlarged view of the encircled portion of the sleeve of FIG. 3, FIG. 4 shows a sleeve as part of a side wall of a package for a six pack or cans.

With reference to FIG. 1 of the drawings, a sleeve in accordance with the present invention initially comprises a flat strip of sheet material 1, which is of sufficient area for it to cover a substantial portion of the sides of a container, such as a can or bottle.

The sheet has parallel upper and lower edges 1*a*, 1*b*, and has side edges 2*a*, 2*b*, one of which, 2*a*, is inclined at an acute angle to the upper edge 1*a* of the strip, and the other of which, 2*b* is inclined at an obtuse angle to the upper edge of the strip.

The respective end edges extend substantially parallel to one another, and define a shape having generally the form of a parallelogram, the respective end edges extending substantially parallel to each other.

Each end edge is formed with a finger 4 that defines a slot 5 having side edges 6, 6. The side edges 6,6 are spaced from each other by a distance slightly in excess of the thickness of the sheet material, thus providing relatively narrow slots, which, in the flattened condition of the strip, extend substantially parallel to each other.

The corners 7 of the strip are rounded, as are the corners 8 of the fingers 4, in order to facilitate assembly of the strip into a cylindrical form, and, also, to facilitate the positioning of the strip in its assembled cylindrical form over the exterior of the can or bottle.

FIGS. 2 and 2*a* of the drawings indicate the assembly steps for the sleeve.

Firstly, the sleeve is formed into a cylinder by rotating the ends of the strip towards each other to bring the fingers 4*a* and 4*b* into proximity with each other. The finger 4*a* is then passed behind the strip, and the finger 4*b* is passed behind the strip, and, the strip is then contracted in circumference to bring the respective slots 5,5 into alignment. To effect this maneuver, it is necessary to raise the end edge of the strip carrying the FIG. 4*a*, and, to lower the end edge of the strip carrying the finger 4*b*. The respective end edges of the strip can then be moved towards one another in the circumferential direction to position the fingers 4*a* and 4*b* behind the strip, and, to bring the respective slots 5, 5 into alignment with one another. The respective end edges of the strip can then be moved in an opposite direction to cause the respective slots to interlock with one another, as illustrated in FIG. 2*a*.

In the assembled condition of the sleeve, the fingers and their associated slots extend parallel to one another, the closed ends 9,9 of the respective slots at that time being engaged one with the other, and providing a hinge or fulcrum about which the respective end edges of the sleeve can be rotated to move the assembled sleeve from a truly cylindrical condition, as illustrated in FIG. 3, into the form of a frustum of a cone, as illustrated in FIG. 2*a*. Thus, in that frusto-conical condition, a can easily can be inserted into the larger diameter end of the frustum, and then passed upwardly within the sleeve, until it meets the diameter of the cone defined by the ends 9, 9 of the slots 5, 5. Continued upwards movement of the can within the sleeve towards the smaller diameter end of the frustum will then force the sleeve back into a truly cylindrical condition, allowing the full insertion of the can within the sleeve, while at the same time developing a hoop stress in the sleeve acting to maintain the sleeve in closely embracing relationship with the outer surface of the can or bottle.

The distance between the slot edges 6*a* of the sleeve, which are locked together when the sleeve is under tension, determines the tightness of the sleeve on the container to which it has been fitted.

Once the sleeve is fitted on a container, it can only be removed by sliding it axially off the container, the integrity of the joint being enhanced by the inclined edges 6 of the respective slots, and, by the fact that the sleeve is a tight fit on the container.

Because one of the fingers is pointing down the edge of the sleeve associated with the downward pointing finger meets greater frictional resistance than the other edge where the finger is pointing upwards. The inclined slots act to resist misalignment of the top and bottom edges of the sleeve at the vital moment when the sleeve is fully stretched and the sidewalls parallel. If the container is a can the "fully stretched" condition occurs when the sleeve is almost halfway onto the can. At this stage frictional resistance is intensifying and the angled slots continue to resist misalignment of the joined edges as the sleeve is pushed the rest of the way.

As is readily apparent, in the assembled condition of the strip to provide the sleeve, the hinging movement can be either in a direction to form a frustum of a cone having its smaller diameter at the upper end thereof, in which case the container would be inserted through the lowermost portion of the sleeve, or, it can just as easily be hinged in the opposite direction so that the larger diameter of the frustum is at the top, in which case the container can be passed downwardly into the assembled sleeve.

FIGS. 2 and 2A of the drawings indicate the assembly steps for the sleeve. The sleeve is formed into a cylinder in a movement which involves matching the longitudinal edges 2 thereof and engaging finger 4A with finger 4*b* so that the longitudinal edges are locked together and overlapped. Once assembled the bottom 9 of each of the slots 5 lock together and resist disengagement of the edges in a horizontal plane but allows the ends of the cylinder so formed to spread with respect to one another. The erected cylinder of FIG. 2A can then be slipped over and onto a drinks container such as a can (FIG. 3). The sleeve is pushed with simple downward hand pressure onto the can and the sleeve forms into a regular configuration conforming to the shape of the can with the sides of the sleeve gradually becoming parallel as the sleeve is pushed onto the container.

The distance between slot edges 6*a* of the sleeve which lock together when the sleeve is under tension determine the tightness of the sleeve on the container to which it is fitted.

Once the sleeve is fitted on a container it can only be removed by sliding it off the container. The integrity of the joint is enhanced by the inclined edges 6 of the slots and the fact that the sleeve is a tight fit on the container.

Mentioned earlier was the fact that a chilled drinks container forms a thin film of condensation on its outer surface once it is removed from a refrigerator. The sleeve is designed to be tight push fit on the container and condensation helps to provide lubrication between the inner surface of the sleeve and the outer surface of the can as the sleeve is slipped onto the can and the joint tolerance is taken up. The condensation is retained by the sleeve for some time making it very difficult to remove the sleeve and in fact some considerable force is required to reverse the procedure and it is very unlikely that the sleeve could be inadvertently removed until the drink within the container has been consumed.

The use of a relatively thin sheet material. The joint and the advantage given by the natural condensation on the can means that there is no need to secure the sleeve relative to the ends of the can which in turn enables the sleeve to be produced relatively cheap. The sleeve can be cut from cardboard, such as 370 micron manilla which provides adequate stiffness and resilience to tearing, and also good insulation qualities, or a laminate of cardboard and plastics, or plastics sheeting. Because of the nature of the joint for the sleeve any material which exceeds 2.5 millimeters in thickness will cause difficulties when the sleeve is attached to cans in particular because the ends of the fingers 4 are likely to catch on the lip of the can.

The joint illustrated resist circumferential expansion of the sleeve once it is assembled and placed on a container and in all cases overlapping portion of the edges of the sleeves are on the inside of the sleeve. Where the sheet material is a laminate of cardboard and plastics sheet, particularly where the plastics sheet occurs on the inner surface of the sleeve the grip of the sleeve of the container is greatly enhanced especially on a chilled can as the film traps condensation and makes it extremely difficult to slide the sleeve on the container.

Standard drink cans and small bottles are designed to be held. An advantage of the sleeve of the present invention by comparison with other products is that a thin sheet material does not greatly increase the diameter of a container to which it is fitted. Because the sleeve insulates the hand from the coolness or hotness of the container. Because the sleeve is relatively inexpensive to produce it is an ideal advertising designed to increase the sales of products such as drinks.

A sleeve is constructed of a sheet material which is a laminate of an outer layer of cardboard and an inner layer of a thin heat reactive plastics is a particularly suitable construction for use with hot drinks, because the inner surface of plastics film can be specified to become tacky as a result of heat transfer to it enhancing the grip of the sleeve on the can.

FIG. 4 of the drawings shows how the strip 1 can be incorporated as a tear-out portion of a cardboard six-pack can package. Alternatively, the strip can be readily dispensed by a drink vending machine.

Aspects of the present invention have been described by way of example only and it would be appreciated that modifications and additions thereto may be made without departing from the scope thereof, as defined in the appended claims.

What is claimed is:

1. An insulating cover for a container, said cover comprising a sheet material of sufficient area to cover substantially all parallel side surfaces of the container, wherein ends for the sheet material have complementary joining means comprising vertically inclined open-ended slots flanked by fingers which can be interlocked and overlapped to form the sheet material into an open ended cylinder of selected diameter, said slots extending parallel to each other in non-perpendicular relation to top and bottom edges of the sheet material so that sliding interengagement of said slots relative to each other is other than in a solely axial direction of said cylinder, said complementary joining means allowing the cylinder ends to fan out to facilitate the application of the cover over said container and being effective to prevent subsequent circumferential expansion of the cover, and prevent unintentional removal of said cover when applied to said container.

2. An insulating cover for a drink container, said cover comprising a sheet of a stiff, flexible sheet material of sufficient area to cover substantially all of the axial side surfaces of the container, said sheet being formable into an open ended cylinder of selected diameter which is a force-fit on the container, opposed ends of the sheet having complementary joining means effective to prevent circumferential expansion of the cover when assembled into its cylindrical form and force fitted over said container, aid joining means comprising vertically inclined open-ended slots flanked by fingers which interlock and overlap when the cover is formed into a cylinder, said slots extending parallel to each other in non-perpendicular relation to top and bottom edges of the sheet so that sliding interengagement of said slots relative to each other is other than in a solely axial direction of said cylindrical form, said fingers being operative to prevent unintentional removal of said cover when applied to said container, said interlocked fingers defining a fulcrum at the interengaged ends of said slots about which said sheet can be hinged from an axially straight cylindrical condition to a frusto-conical condition defining a frustum of a cone thus permitting the ready insertion of said container into the larger of the diameters of said frustum.

* * * * *